US006277453B2

(12) United States Patent
Weder

(10) Patent No.: US 6,277,453 B2
(45) Date of Patent: Aug. 21, 2001

(54) METHOD OF PACKAGING, STORING AND TRANSPORTING DECORATIVE GRASS

(75) Inventor: Donald E. Weder, Highland, IL (US)

(73) Assignee: Southpac Trust International, Inc.

( * ) Notice: Subject to any disclaimer, the term of this patent is extended or adjusted under 35 U.S.C. 154(b) by 0 days.

(21) Appl. No.: 09/741,703

(22) Filed: Dec. 19, 2000

Related U.S. Application Data

(63) Continuation of application No. 09/177,030, filed on Oct. 22, 1998, now abandoned.

(51) Int. Cl.[7] ..... A41G 1/00

(52) U.S. Cl. ..... 428/17; 206/83.5; 206/417; 206/521; 100/3

(58) Field of Search ..... 428/17; 206/83.5, 206/417, 521; 100/3

(56) References Cited

U.S. PATENT DOCUMENTS 3,244,275 4/1966 Murley .
4,884,682 * 12/1989 Weder et al. .

OTHER PUBLICATIONS

Highland Supply Corporation brochure for Highlander Shredded Grasses; 1 page (front and back).

* cited by examiner

*Primary Examiner*—Deborah Jones
*Assistant Examiner*—Wendy Boss
(74) *Attorney, Agent, or Firm*—Dunlap, Codding & Rogers, P.C.

(57) ABSTRACT

A bale of decorative grass comprising a quantity of strands of decorative grass compressed into a single bale of decorative grass having a weight in a range of 400 to 800 pounds and means for removably securing the strands of decorative grass in the bale.

10 Claims, 2 Drawing Sheets

METHOD OF PACKAGING, STORING AND TRANSPORTING DECORATIVE GRASS

CROSS-REFERENCE TO RELATED APPLICATIONS

This application is a continuation of U.S. Ser. No. 09/177,030, filed Oct. 22, 1998, entitled "METHOD OF PACKAGING, STORING AND TRANSPORTING DECORATIVE GRASS", now abandoned.

STATEMENT REGARDING FEDERALLY SPONSORED RESEARCH OR DEVELOPMENT

Not applicable.

BACKGROUND OF THE INVENTION

1. Field of the Invention

The present invention relates generally to packaging materials for packaging articles, and more particularly, but not by way of limitation, to a method of packaging, storing and transporting decorative grass by forming a quantity of decorative grass into a bale that weighs significantly more than previously produced bales of the same material.

2. Brief Description of the Related Art

Strips of sheet material, commonly known as decorative grass or Easter grass, have been used for many years to provide a decorative as well as cushioning effect in fruit baskets, Easter baskets, and picnic baskets. Decorative grass has been produced by numerous methods and from a variety of materials such as polymeric materials, paper, cellophane, or the like. Typically, such materials are cut and shredded to produce segments having predetermined dimensions.

In use, strips of decorative grass are formed into small tufts which are placed on a table or in a basket to provide a decorative and protective cushion. Because decorative grass is used by consumers in small quantities, decorative grass has previously been packaged in bags weighing 2 to 16 ounces, in cartons weighing 5 to 10 pounds, or in bales weighing 5 to 100 pounds. While packaging decorative grass in these manners has become well accepted in the decorative grass industry, inefficiencies are nevertheless encountered in the packaging, storage, and transportation of decorative grass, particularly with respect to bales. For example, the decorative grass forming the outer surface of the bale has a tendency to get soiled during transport and storage, thereby requiring the soiled portion of the bail to be disposed of or otherwise recycled prior to use. In addition, the relatively small size of these bales of decorative grass make them relatively unstable when stacked on one another, and thus unsafe. Further, these stacks must be made by persons manually stacking the bales onto pallets or onto a floor which results in significant handling costs.

To this end, a need exists for an improved method of packaging decorative grass which results in less product waste, facilitates handling while reducing handling costs, and increasing safety. It is to such a method that the present invention is directed.

BRIEF SUMMARY OF THE INVENTION

The present invention is directed to a bale of decorative grass comprising a quantity of strands of decorative grass weighing in a range of 400 to 800 pounds compressed into a single bale of decorative grass and means for removably securing the strands of decorative grass in the bale.

In another aspect, the present invention is directed to a method of packaging strands of decorative grass wherein the strands of decorative grass have a length and a generally rectangularly shaped cross section. The method includes (1) amassing a quantity of strands of decorative grass weighing in a range of 400 to 800 pounds; and (2) compressing and securing the quantity of strands of decorative grass into a single bale of decorative grass.

The objects, features and advantages of the present invention will become apparent from the following detailed description when read in conjunction with the accompanying drawings and appended claims.

DETAILED DESCRIPTION OF THE INVENTION

Figure 1:
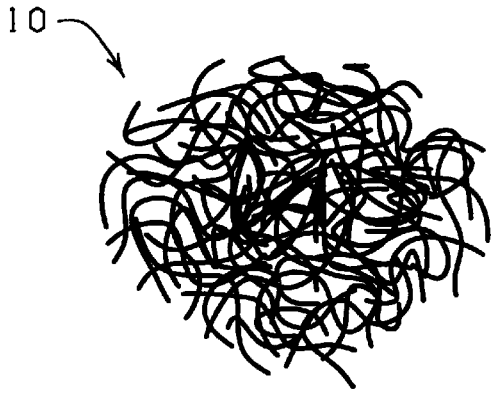
FIG. 1 is a perspective view of a tuft of decorative grass.
Figure 2:
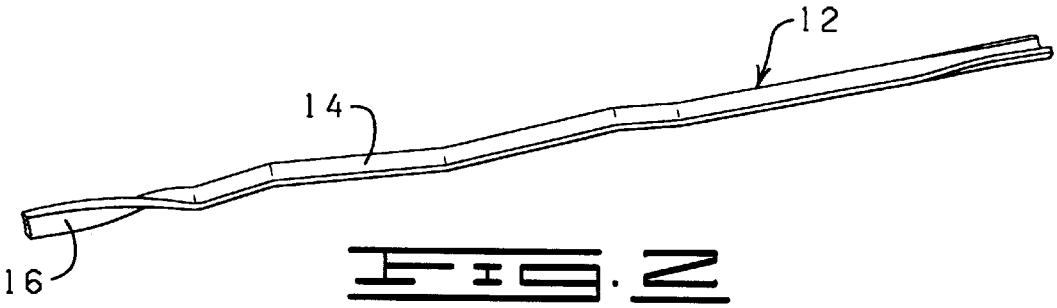
FIG. 2 is a perspective view of a strip of material used to form the tuft of decorative grass of FIG. 1.

Referring now to the drawings, and more specifically to FIGS. 1 and 2, a tuft 10 of decorative grass is illustrated in FIG. 1. The tuft 10 is comprised of a plurality of individual strips or strands of decorative grass 12 (FIG. 2), each characterized as having a first side 14 and a second side 16. The term "decorative grass" or "Easter grass" as used herein means an artificial strand of grass-like material fabricated from any flexible sheet of material, including paper, polymeric film, laminated polymeric film, metalized foil film and waxed paper, for example, and each strand of material having a length generally in a range from about 3 inches to about 20 inches, a width in a range generally from about 1/64 inch to about ¼ inch and a thickness generally in a range from about 0.0004 inch to about 0.004 inch.

The decorative grass may have printed matter and/or embossed pattern on at least one side thereof, and the embossed pattern can be either in register or out of register with the printed pattern. The printed pattern can be printed on the sheet material used to fabricate the decorative grass in a conventional matter so that when the sheet of material is slit and cut to produce the decorative grass 12, at least a substantial portion of the decorative grass 12 contains at least a portion of the printed pattern. Further, different colors can be employed to provide the printed pattern on the decorative grass.

The decorative grass can also be embossed so as to provide the decorative grass with an embossed pattern. Further, the decorative grass can be provided with an embossed pattern as well as a printed pattern, and the embossed pattern can be either in register or out of register with the printed material and/or printed design.

Decorative grass or Easter grass, as mentioned above, has been used for many years for filling fruit baskets, Easter baskets, and picnic baskets and for other decorative and packaging purposes. The decorative grass of the prior art has been produced by numerous methods and from a variety of materials, such as those listed above. Typically, such materials are shredded and cut to produce segmented strips having predetermined dimensions. While the prior art methods for making decorative grass have been widely accepted, new methods for packaging, storing, and transporting decorative grasses are sought to overcome the inefficiencies of the packaging methods discussed above.

Figure 3:
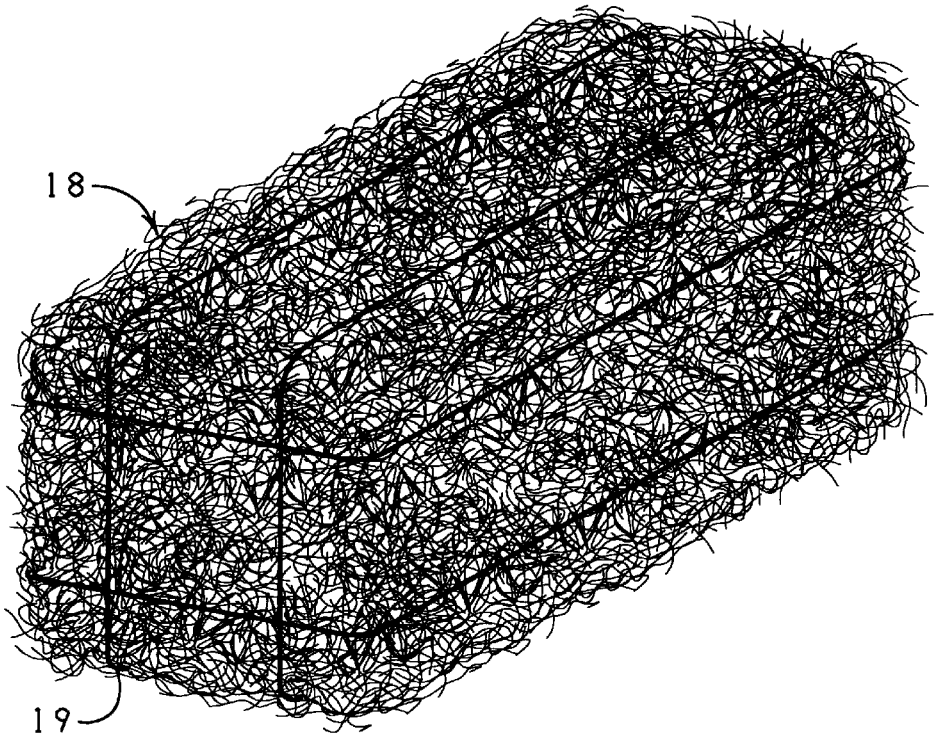
FIG. 3 is a perspective view of a bale of decorative grass constructed in accordance with the present invention.

One technique for achieving these desired results is to package decorative grass in a bale having a size significantly greater than previous bales of decorative grass. More specifically, a bale 18 of decorative grass constructed in accordance with the present invention is illustrated in FIG. 3. The bale 18 of decorative grass is formed with a quantity of decorative grass so that the bale 18 has a weight in a range of 400 to 800 pounds and a cylindrical, square, or rectangular configuration. By way of example, the bale 18 illustrated in FIG. 3 is rectangular in shape with dimensions of about 5 ft×3½ ft×3⅔ ft.

The bale 18 is formed by amassing a quantity of strands of decorative grass weighing in a range of 400 to 800 pounds. The amassed quantity of strands of decorative grass is then compressed into a single bale of decorative grass. The bale 18 is secured together in a conventional manner with a binding material 19, such as strands of wire or twine, straps, or the like.

Figure 4:
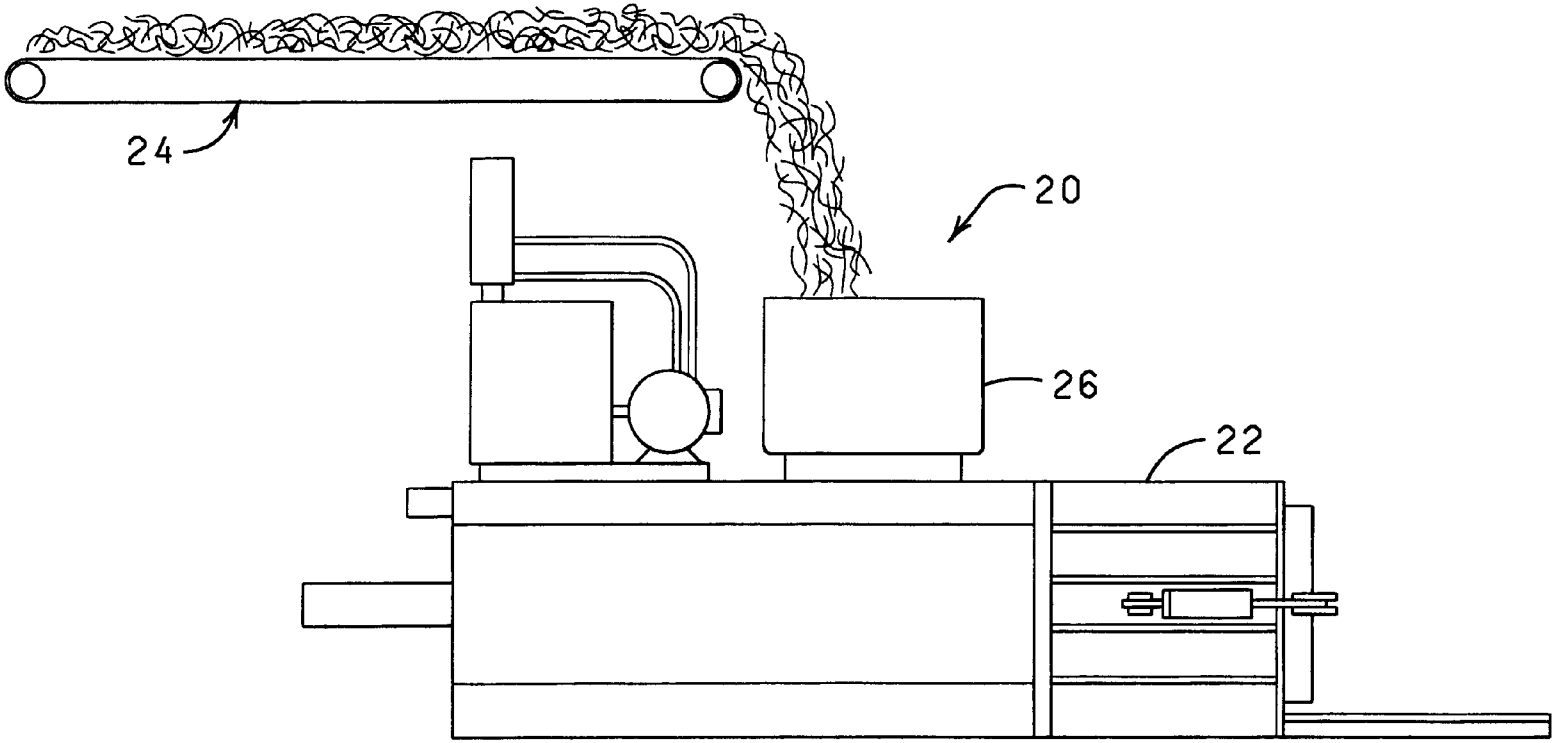
FIG. 4 is a schematic representation of a system for making the bale of decorative grass of FIG. 3.

FIG. 4 schematically illustrates a system 20 for producing bales of decorative grass in accordance with the present invention. The system 20 includes a baler apparatus 22 and a conveyor 24 for depositing decorative grass into a hopper 26 of the baler apparatus 22. The baler apparatus 22 can be any suitable apparatus for baling stripped or segmented materials, such as the baler apparatus commercially available from American Baler Company of Bellevue, Ohio, model no. 50299R5W. Balers are well known in the art. Thus, no further description of their components, construction, or operation is believed necessary in order for one skilled in the art to understand and implement the method of the present invention.

One of the advantages of baling decorative grass in larger and heavier bales is that a lesser amount of packaging is required to keep the bales clean and therefore a lesser amount of waste goes into landfills. Handling costs are also lowered due to the fact that larger bales can be handled using pallet trucks or forklifts. In addition, larger bales provide for greater ease of stacking and warehousing. That is, smaller bales which are stretch wrapped or bagged tend to slip and make for an unstable stack. Further, these stacks must be formed by individuals who manually stack the bales onto a pallet or onto the floor. Larger bales can be stacked with a forklift and have a larger exterior surface area thereby making for a more stable and safe stack. Finally, the formation of a larger bale of decorative grass allows for the use of lesser amounts of twine or other binding material per pound of decorative grass than used for the previous smaller bales.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A bale of decorative grass, comprising:

a quantity of strands of decorative grass compressed into a single bale of decorative grass having a weight in a range from about 400 to about 800 pounds and having an outer surface area of at least about ninety-seven square feet; and means for removably securing the strands of decorative grass in the bale.

2. The bale of decorative grass of claim 1 wherein the bale of decorative grass has a substantially rectangular configuration.

3. The bale of decorative grass of claim 1 wherein the strands of decorative grass are fabricated from a material selected from a group of materials consisting of: paper, polymeric materials, metalized foil film, laminates thereof, and combinations thereof.

4. The bale of decorative grass of claim 1 wherein the length of each strand of decorative grass is in a range from about 3 inches to about 20 inches, and wherein each strand of decorative grass has a width in a range from about 0.0156 inch to about 0.25 inch and a thickness in a range from about 0.0004 inch to about 0.004 inch.

5. A method of packaging strands of decorative grass wherein the strands of decorative grass have a length and a generally rectangularly shaped cross section, comprising:

amassing a quantity of strands of decorative grass; and compressing and securing the quantity of strands of decorative grass into a single bale of decorative grass having a weight in a range from about 400 to about 800 pounds and an outer surface area of at least about ninety-seven square feet.

6. The method of claim 5 wherein the bale of decorative grass has a substantially rectangular configuration.

7. The method of claim 5 wherein the strands of decorative grass are fabricated from a material selected from a group of materials consisting of: paper, polymeric materials, metalized foil film, laminates thereof, and combinations thereof.

8. The method of claim 5 wherein the length of each strand of decorative grass is in a range from about 3 inches to about 20 inches, and wherein each strand of decorative grass has a width in a range from about 0.0156 inch to about 0.25 inch and a thickness in a range from about 0.0004 inch to about 0.004 inch.

9. A bale of decorative grass, comprising:

a plurality of strands of decorative grass amassed into a substantially rectangularly shaped bale of decorative grass having a weight in a range from about 400 to about 800 pounds and having an outer surface area of at least about ninety-seven square feet, each strand of decorative grass having a substantially rectangular configuration and having a length from about three inches to about twenty inches; and means for removably securing the strands of decorative grass in the bale.

10. A method of packaging strands of decorative grass wherein the strands of decorative grass, comprising:

amassing a quantity of strands of decorative grass having a weight in a range from about 400 to about 800 pounds, each strand of decorative grass having a substantially rectangular configuration and having a length from about three inches to about twenty inches; and securing the strands of decorative grass into a bale having a substantially rectangular configuration and an outer surface area of at least about ninety-seven square feet.

* * * * *

UNITED STATES PATENT AND TRADEMARK OFFICE

CERTIFICATE OF CORRECTION

PATENT NO. : 6,277,453 B2
DATED : August 21, 2001
INVENTOR(S) : Donald E. Weder

It is certified that error appears in the above-identified patent and that said Letters Patent is hereby corrected as shown below:

Column 2,
Line 44, after word "conventional" and before word "so" change word "matter" to word -- manner --

Signed and Sealed this

Twenty-seventh Day of July, 2004

JON W. DUDAS
*Acting Director of the United States Patent and Trademark Office*